US005697103A

United States Patent [19]

Wiggins

[11] Patent Number: 5,697,103

[45] **Date of Patent: *Dec. 16, 1997**

[54] THERAPEUTIC GLOVE

[75] Inventor: John Wiggins, Ozone Park, N.Y.

[73] Assignee: Personal Expression I, Inc., New York, N.Y.

[ * ] Notice: The term of this patent shall not extend beyond the expiration date of Pat. No. 5,373,585.

[21] Appl. No.: 490,567

[22] Filed: Jun. 15, 1995

Related U.S. Application Data

[63] Continuation-in-part of Ser. No. 295,278, Aug. 24, 1994, abandoned, which is a continuation-in-part of Ser. No. 2,649, Jan. 11, 1993, Pat. No. 5,373,585.

[51] Int. Cl.[6] ..... A41D 19/00

[52] U.S. Cl. ..... 2/159; 2/162; 2/163; 2/917

[58] Field of Search ..... 2/163, 161.7, 161.2, 2/159, 162, 16, 160, 161.1, 161.6, 917

[56] References Cited

U.S. PATENT DOCUMENTS

| | | | |
|---|---|---|---|
| 3,105,972 | 10/1963 | Christopher | 2/161.2 |
| 3,593,803 | 7/1971 | Ibach | 2/160 |
| 4,684,123 | 8/1987 | Fabry | 2/161 A |
| 4,698,850 | 10/1987 | Patton, Sr. et al. | 2/159 |
| 4,766,612 | 8/1988 | Patton, Sr. | 2/163 |
| 4,796,306 | 1/1989 | Mitchell | 2/163 |
| 4,830,360 | 5/1989 | Carr, Jr. | 272/67 |
| 4,881,275 | 11/1989 | Cazares et al. | 2/168 |
| 5,022,094 | 6/1991 | Hames et al. | 2/159 |
| 5,033,120 | 7/1991 | Myers | 2/161.2 |
| 5,067,175 | 11/1991 | Gold | 2/16 |
| 5,224,220 | 7/1993 | Andriola | 2/163 |
| 5,435,013 | 7/1995 | Davis | 2/163 |

FOREIGN PATENT DOCUMENTS 2237726 5/1991 United Kingdom .

*Primary Examiner*—Amy B. Vanatta
*Attorney, Agent, or Firm*—Collard & Roe, P.C.

[57] ABSTRACT

A therapeutic glove for exercising the fingers of a hand includes a glove body having finger and thumb portions each with a tip, an anchor rod for each finger and thumb portion, an elastic resistance band extending along the back of each finger and thumb portion from the tip to the anchor rod, an adjustable wrist portion using a hook and loop type fastener, and an elastic resilient band located on the back of the glove and connected to the anchor rod for each finger at one end and releasably connected to the wrist portion at the opposite end.

11 Claims, 6 Drawing Sheets

THERAPEUTIC GLOVE

CROSS REFERENCE TO RELATED APPLICATION

This is a continuation-in-part patent application of U.S. patent application Ser. No. 08/295,278, filed Aug. 24, 1994, now abandoned, which is a continuation-in-part patent application of U.S. patent application Ser. No. 08/002,649, filed Jan. 11, 1993, and now U.S. Pat. No. 5,373,585.

BACKGROUND OF THE INVENTION

1. Field of the Invention

The present invention relates to a therapeutic glove for exercising the fingers of a hand, including a glove body having finger portions each with a tip, a ring surrounding the tip of each finger portion, an anchor rod for each finger portion, a Channel below the surface of the glove body extending along the back of each finger portion from the ring to the anchor rod, and an elastic resistance band located in the channel and connecting together the ring and the anchor rod.

2. The Prior Art

The therapeutic glove for exercising the fingers of the hand is particularly useful for people who have suffered hand injuries, and need to perform therapeutic exercises to help build back the weak muscles of the fingers.

Most prior art therapeutic devices operate in the palm of the hand where a person either grips a spring-loaded pair of handles or squeezes some putty or a soft rubber object, such as a ball, in order to exercise the fingers. However, this can cause damage to the palm of the hand. In the past there have been attempts to solve this type of problem, and prior proposals are as follows.

The Fabry U.S. Pat. No. 4,684,123 discloses a weighted exercise glove garment having at least one pocket made of an elastic material positioned over the back of the wearer's hand. This elastic material can be stretched to snugly hold one or more objects such as weights.

The Patton U.S. Pat. No. 4,766,612 discloses a protective work glove which comprises a glove having finger- and hand-protective chambers insertable therein. Specifically, there is a flexible connector which connects together protective members, which members may be made of metal, plastic or any other lightweight stiff material, such as aluminum, PVC or a fiber-reinforced plastic. The flexible connector strip could be made of cloth or a plastic strip such as polyolefin, nylon or the like. A foam layer may be plastic or elastic foam having a good tear resistance.

The Gold U.S. Pat. No, 5,067,175 discloses a padded glove which selectively protects certain portions of the wearer's hand. There are padded chambers located along the back of the hand and extending from approximately the tips of the fingers across the back of the hand portion and down to the wrist seam. It is indicated that the padding is preferably a continuous strip of foam padding. It is stated that the padded chambers can be narrow padding and cover only a small portion of the fingers in the glove.

However, the Gold patent, which has various padded chambers along the back of the foam-padded finger portions of the glove, does not suggest having elastic bands to exercise the fingers for therapeutic effects. The Gold patent also does not indicate that the various padded chambers which are used to protect the wearer's hand have the type of resiliency needed to cause bent fingers to spring back and straighten out, nor does it disclose specific structure for affixing the bands to the back of the gloves, namely, the rings at the tip of the fingers and the attachment means at the back of the glove.

SUMMARY OF THE INVENTION

It is an object of the present invention to provide a therapeutic glove for exercising the fingers of a hand, including a glove body having finger portions each with a tip, a ring surrounding the tip of each finger portion, an anchor rod for each finger portion, a channel below the surface of the glove body extending along the back of each finger portion from the ring to the anchor rod, and an elastic resistance band located in the channel and connecting together the ring and the anchor rod.

This invention relates to a therapeutic glove for exercising the fingers of the hand. The glove is particularly useful for people who have suffered hand injuries and therefore must perform therapeutic exercises to help recondition the weak muscles of the fingers. Rubber bands are placed on the outer portion of the fingers of the glove so that when the hand is closed, the rubber bands stretch. When the rubber bands retract, the fingers are pulled up and are straightened out. The rubber bands are secured at the knuckle area of the glove, and at the tips of the fingers, and are sewed into channels in the gloves so that they do not splay apart as the hand is closed. The inventive device operates on the fingers from the outside of the palm, thereby preventing damage to the palm of the hand.

In addition, there is a heavy rubber ring around the tip of each finger of the glove. Additionally, there are rod-shaped means made from metal, ceramic or hard plastic at the knuckle portion of the glove upon which it is possible to anchor the heavy rubber band in order to hold it in position between the ring finger tip and the anchoring rod means at the knuckle portion of the glove.

The advantages of the present invention are as follows.

The therapeutic glove is designed to strengthen a person's hands, fingers, and forearms. This is a lightweight glove with a heavy rubber ring at the tip of each finger, and a strong elastic band down the back of each finger to a brace, where it anchors. It increases circulation in the hand to relieve swelling and aids against edemas. The movement of each finger helps strengthen weak muscles in the fingers and joints, and strengthens the muscles in the forearms as well, improving blood circulation. As blood circulation increases, all muscles located in the fingers, forearms, wrist, and joints of the hands are strengthened. It is directed toward a therapeutic healing of muscles, as well as strengthening these muscles, and therefore is also useful for arthritic hand therapy, for weak hands, fingers, and wrists. In addition to arthritic patients at home, the therapeutic glove can be used in hospitals or nursing homes, by athletes, and by persons who use their hands for their livelihood, such as keyboard operators and musicians, and for persons who have chronic pain from injuries, such as veterans.

In addition, the therapeutic glove is flexible, lightweight, and machine washable, and can be made of leather, cloth, or a combination thereof.

The present invention achieves these objects and advantages and is directed to a therapeutic glove for exercising the fingers of the hand, comprising a glove body having finger portions each with a tip, a ring surrounding the tip of each finger portion, an anchor rod for each finger portion, a channel below the surface of the glove body extending along the back of each finger portion from the ring to the anchor rod, and an elastic resistance band located in the channel and connecting together the ring and the anchor rod.

The above objects and advantages can be achieved according to the present invention by providing a therapeutic glove for exercising the fingers of the hand, comprising a glove body having a back adapted to overlie the back of the hand, a palm-covering portion for covering the palm of the hand, a front end comprising four separate finger portions into which a finger of the hand may be inserted, a thumb portion into which the thumb of the hand may be inserted, a rear opening for receiving the hand, and a middle part positioned between the front end and the rear opening for covering the knuckles of the hand. The glove includes each finger portion having a tip and the thumb portion having a tip, ring means for surrounding the top of each finger portion and a ring means for surrounding the tip of the thumb portion, anchor rod means located in said middle part for each finger portion and for said thumb portion, channel means below the surface of the glove body and extending along the back of each finger portion from said ring means to said anchor rod means, extending along the back of the thumb portion from said ring means to said anchor rod means. The elastic resistance bands have a first and a second end located in said channel means connected at said first end to said ring means, and connected to said second end to said anchor rod mean, whereby whenever the fingers and the thumb of the hand are closed, the elastic resistance bands are stretched, exerting a reverse counterforce, thus pulling the fingers and thumb back straight so as to open the hand, and aiding in exercising the fingers of the hand.

In a second embodiment of the invention, an adjustable wrist band is provided for securely fastening the glove to the users hand. In addition, a retaining tab connected to the end of the resilient elastic bands allows for adjustment of the tension of the elasticity of the therapeutic glove. The retaining tab and adjustable wrist band have hook and loop type fasteners to provide a strong and adjustable means for securing the glove on the users hand. Furthermore, in the second embodiment of the invention, the channels for receiving the elastic resistance bands has been removed and the bands are sewn directly to the back portion of each finger. Moreover, the rings surrounding each finger tip have also been removed. With the rings removed, the elastic resistance bands are secured by being sewn into the tip portion of the finger and extending to the anchor rods located in the knuckle portion of the glove.

In a third embodiment and in a fourth embodiment of the invention, an adjustable wrist band is provided for securely fastening the glove to the users hand. In addition, there is an individual retaining tab connected to the end of each of the elastic resistance bands for individual adjustment of the tension of the elasticity of each finger portion of the therapeutic glove. Each individual retaining tab and adjustable wrist band have hook and loop type fasteners to provide a strong and adjustable means for securing the glove on the users hand. Furthermore, in the third and the fourth embodiments of the invention, the channels for receiving the elastic resistance bands may be removed and the bands may be sewn directly to the back portion of each finger. Moreover, the rings surrounding each finger tip may also be removed. With the rings removed, the elastic resistance bands can be secured by being sewn into the tip portion of the finger and extend to the individual tab located at the wrist portion of the glove,

BRIEF DESCRIPTION OF THE DRAWINGS

Other objects and features of the present invention will become apparent from the following detailed description considered in connection with the accompanying drawings which disclose four embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF PREFERRED EMBODIMENTS

Figure 1:
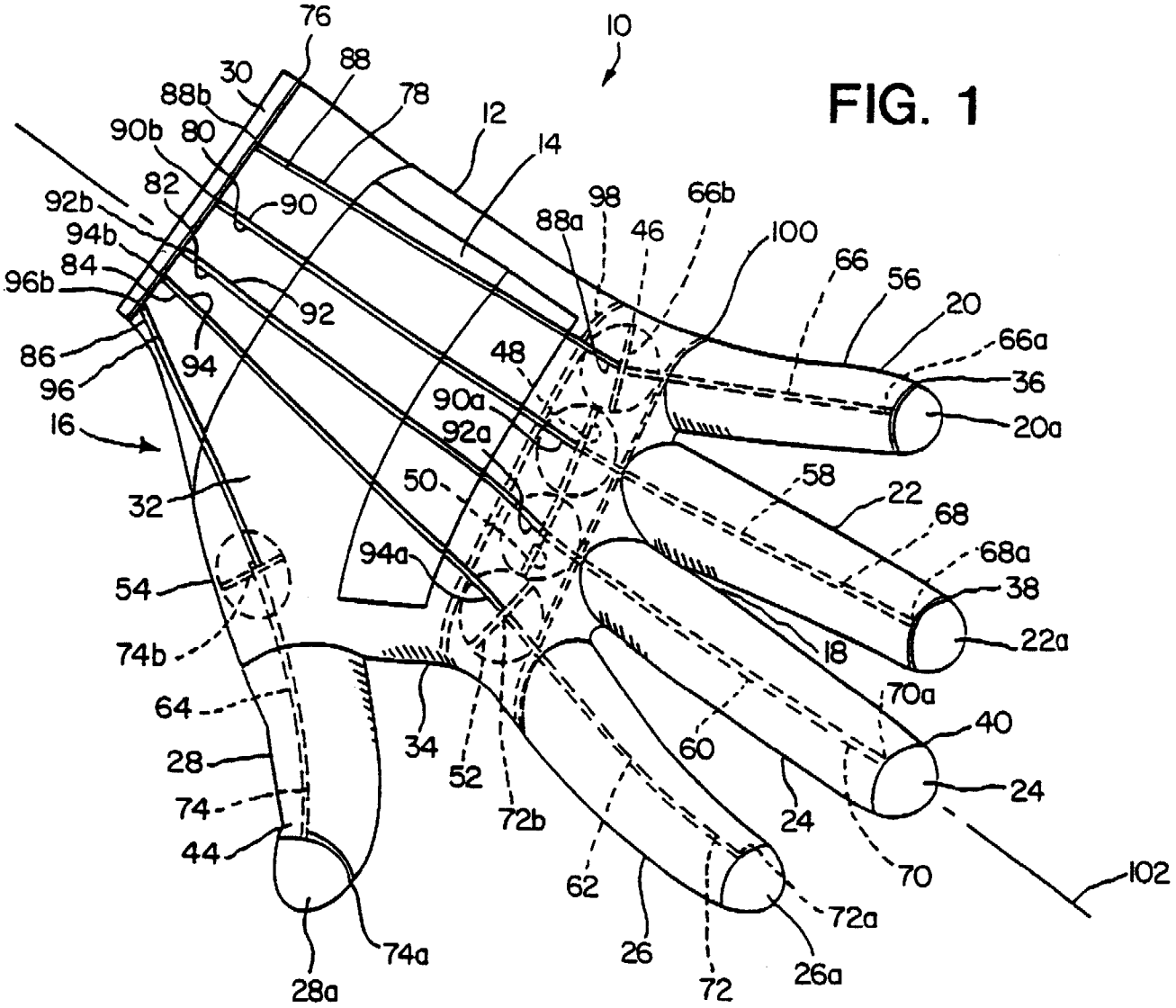
FIG. 1 is a first embodiment of the therapeutic glove according to the present invention.

Turning now in detail to the drawings, FIG. 1 shows a therapeutic glove 10 for exercising the fingers of the hand, including a glove body 12 having a back 14 adapted to overlie the back of the hand. There is included a palm-covering portion 16 for covering the palm of the hand, a front end 18 comprising four separate finger portions 20, 22, 24 and 26 into which a finger of the hand may be inserted, and a thumb portion 28 into which the thumb of the hand may be inserted. Rear opening 30 receives the hand, and a middle part 32 positioned between the front end 18 and the rear opening 30 covers the knuckles portion 34 of the hand.

Each finger portion 20, 22, 24 and 26 has a tip **20*a*, 22*a*, 24*a* and 26*a*, respectively, and the thumb portion 28 has a tip 28*a*. Ring means 36, 38, 40 and 42 surround the tip of each finger portion and ring means 44 surrounds the tip of the thumb portion, with anchor rod means 46, 48, 50 and 52 located in the middle part for each finger portion and anchor rod means 54** for the thumb portion.

Channel means 56, 58, 60 and 62 below the surface of the glove body extend along the back of each finger portion from the ring means 36, 38, 40 and 42 to the anchor rod means 46, 48, 50 and 52. Channel means 64 extends along the back of the thumb portion from the ring means 44 to the anchor means 54.

Elastic resistance bands 66, 68, 70, 72 and 74 each have a first end and a second end located in the channel means and are connected, respectively, at each of first ends **66*a*, 68*a*, 70*a*, 72*a*, and 74*a* to the ring means, and are connected at each of second ends 66*b*, 68*b*, 70*b*, 72*b*, and 74*b*** to the anchor rod means. Therefore, whenever the fingers and the thumb of the hand are closed, the elastic resistance bands are stretched, exerting a reverse counterforce, pulling the fingers and thumb back straight so as to open the hand and aid in exercising the fingers of the hand.

The therapeutic glove also includes a top anchor perimeter rim means 76 for extending across the back of the glove adjacent to the rear opening 30. In addition, the therapeutic glove further includes a cavity means 78, 80, 82, 84 and 86 below the surface of the glove body extending along the back of the glove from each of the anchor rod means 46, 48, 50, 52 and 54 to the top anchor perimeter rim means 76.

Additionally, the therapeutic glove includes elastic resilient bands 88, 90, 92, 94, and 96 each having a first end **88*a***, 90a, 92a, 94a, and 96a, respectively; and a second end 88b, 90b, 92b, 94b, and 96b, respectively. These elastic resilient bands are located, respectively, within the cavity means 78, 80, 82, 84, and 86, and are connected at the first end 88a, 90a, 92a, 94a, and 96a to the anchor rod means 46, 48, 50, 52 and 54, respectively; and are connected at said second end 88b, 90b, 92b, 94b, and 96b to the top anchor perimeter rim means 76. The elastic resilient bands may be the same or different from the elastic resistance bands. Thus, the resilient bands may be made from the same material as the resistance bands. Also, these two bands may be two parts of the same continuous band, or they may be two separate and distinct bands.

First brace means 98 and second brace means 100 adjacent to the anchor rod means each provides lateral strength for the glove body. A ventilation opening is in the palm-covering portion of the glove body (not shown). The glove also includes a center-line longitudinal axis 102, wherein the first brace means 98 and the second brace means 100 are transverse braces extending perpendicular to the longitudinal axis and adjacent to the anchor rod means.

Figure 3:
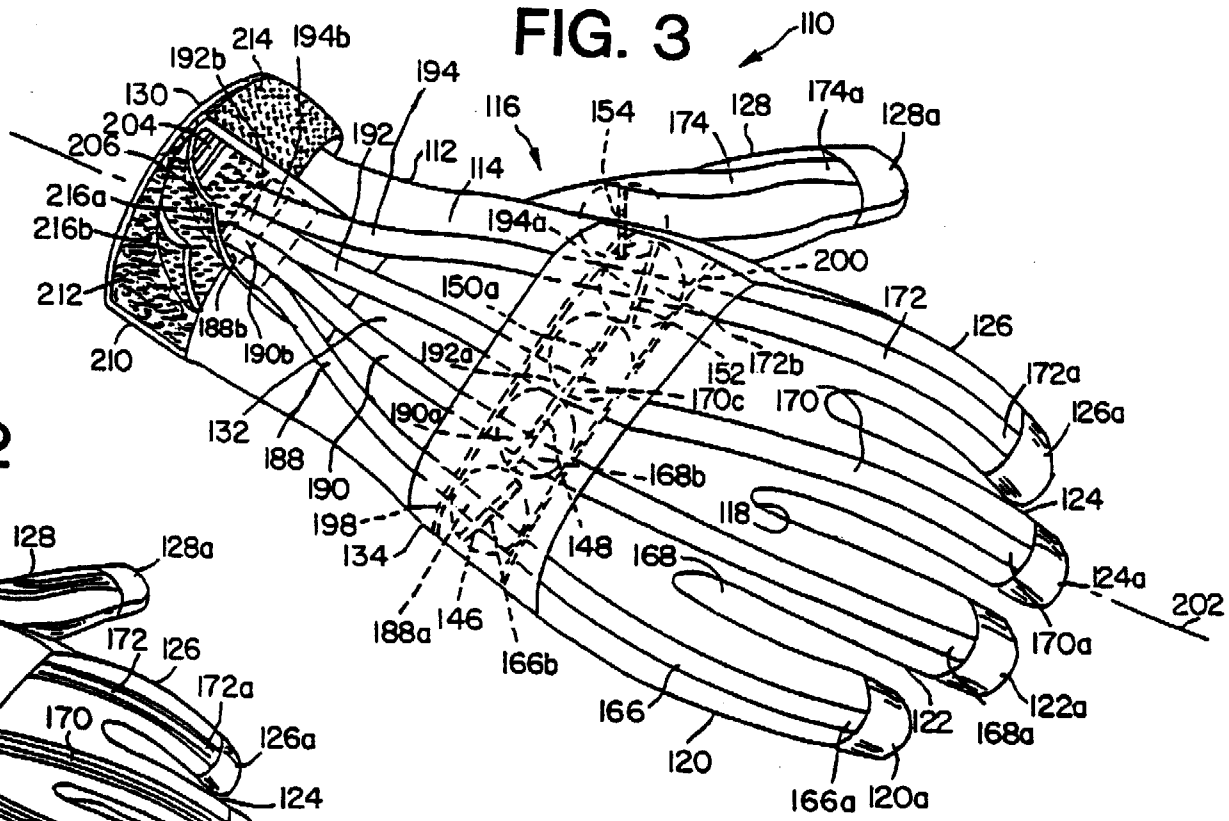
FIG. 3 is a detailed view of the second embodiment of the invention.
Figure 2:
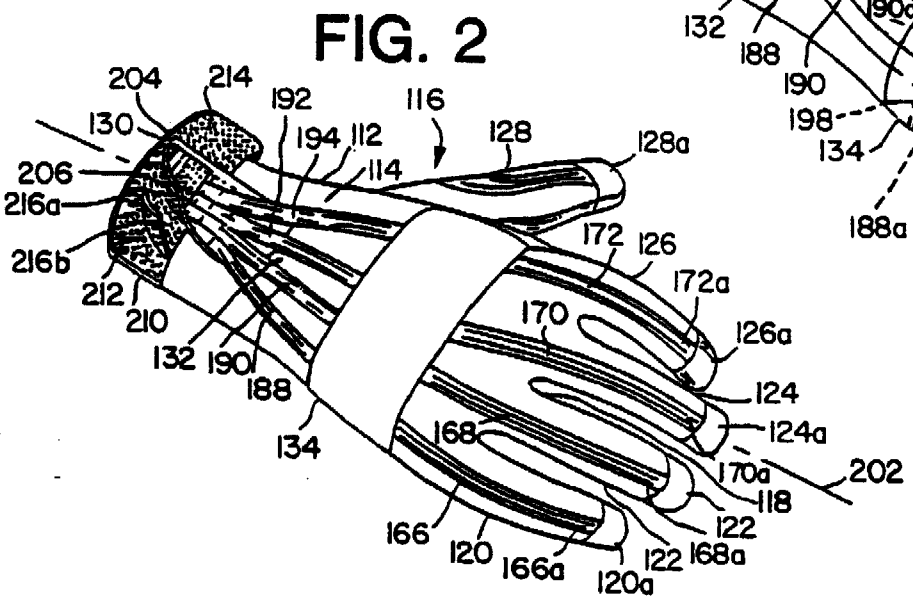
FIG. 2 is a second embodiment of the therapeutic glove according to the present invention.

FIGS. 2 and 3 shows a second embodiment of the therapeutic glove 110 for exercising the fingers of the hand. Glove 110 includes a glove body 112 having a back 114 adapted to overlie the back of the hand. There is included a palm-covering portion 116 for covering the palm of the hand, a front end 118 comprising four separate finger portions 120, 122, 124 and 126 into which a finger of the hand may be inserted, and a thumb portion 128 into which the thumb of the hand may be inserted. Rear opening 130 receives the hand, and a middle part 132 positioned between the front end 118 and the rear opening 130 covers the knuckles portion 134 of the hand.

Each finger portion 120, 122, 124 and 126 has a tip 120a, 122a, 124a and 126a, respectively, and the thumb portion 128 has a tip 128a. Anchor rod means 146, 148, 150 and 152 located in middle part 132 for each finger portion and anchor rod means 154 for thumb portion 128.

Elastic resistance bands 166, 168, 170, 172 and 174 each have a first end and a second end disposed on the back 114 of the glove 110 and are connected, respectively, at each of the first ends 166a, 168a, 170a, 172a, and 174a to the tips 120a, 122a, 124a, 126a and 128a, and are connected at each of the second ends 166b, 168b, 170b, 172b, and 174b to the anchor rod means 146, 148, 150, 152 and 154, respectively. Therefore, whenever the fingers and the thumb of the hand are closed, the elastic resistance bands are stretched, exerting a reverse counterforce, pulling the fingers and thumb back straight so as to open the hand and aid in exercising the fingers of the hand.

The therapeutic glove also includes a wrist portion 210 adjacent rear opening 130. Wrist portion 210 further includes an adjustment strap 214 and a retaining tab 204. Wrist portion 210 is provided with a plurality of loops 212 extending across the back 114 of glove 110 adjacent rear opening 130 and perpendicular to a center-line longitudinal axis 202. The plurality of loops 212 receive a plurality of hooks for use as a hook add loop type fastener. Adjustment strap 214 has an upper and lower side, each of which have a plurality of hooks 216a and 216b, respectively, such that when adjustment strap 214 is wrapped around the users wrist, the hooks 216b, on the lower side of said strap, engage the loops 212 on wrist portion 210 and secure the glove 110 on the users hand.

Additionally, the therapeutic glove includes elastic resilient bands 188, 190, 192 and 194 each having a first end 188a, 190a, 192a and 194a, respectively; and a second end 188b, 190b, 192b and 194b, respectively. These elastic resilient bands are connected at the first end 188a, 190a, 192a and 194a to the anchor rod means 146, 148, 150 and 152, respectively; and are connected at said second ends 188b, 190b, 192b and 194b to retaining tab 204.

Retaining tab 204 has a plurality of loops 206 disposed on the bottom side thereof. When retaining tab is pulled into a comfortable position, the loops 206 engage the hooks 216a on the upper side of adjustment strap 214 and secure elastic resilient bands 188, 190, 192 and 194. The placement of retaining tab 204 allows the tension of the elastic resilient bands to be adjusted according to the size of the users hand.

The elastic resilient bands may be the same or different from the elastic resistance bands. Thus, the resilient bands may be made from the same material as the resistance bands. Also, these two bands may be two parts of the same continuous band, or they may be two separate and distinct bands.

First brace means 198 and second brace means 200 adjacent to the anchor rod means each provides lateral strength for the glove body. A ventilation opening (not shown in the FIGS.) is in the palm-covering portion of the glove body. The glove also includes a center-line longitudinal axis 202, wherein the first brace means 198 and the second brace means 200 are transverse braces extending perpendicular to the longitudinal axis and adjacent to the anchor rod means.

Figure 4:
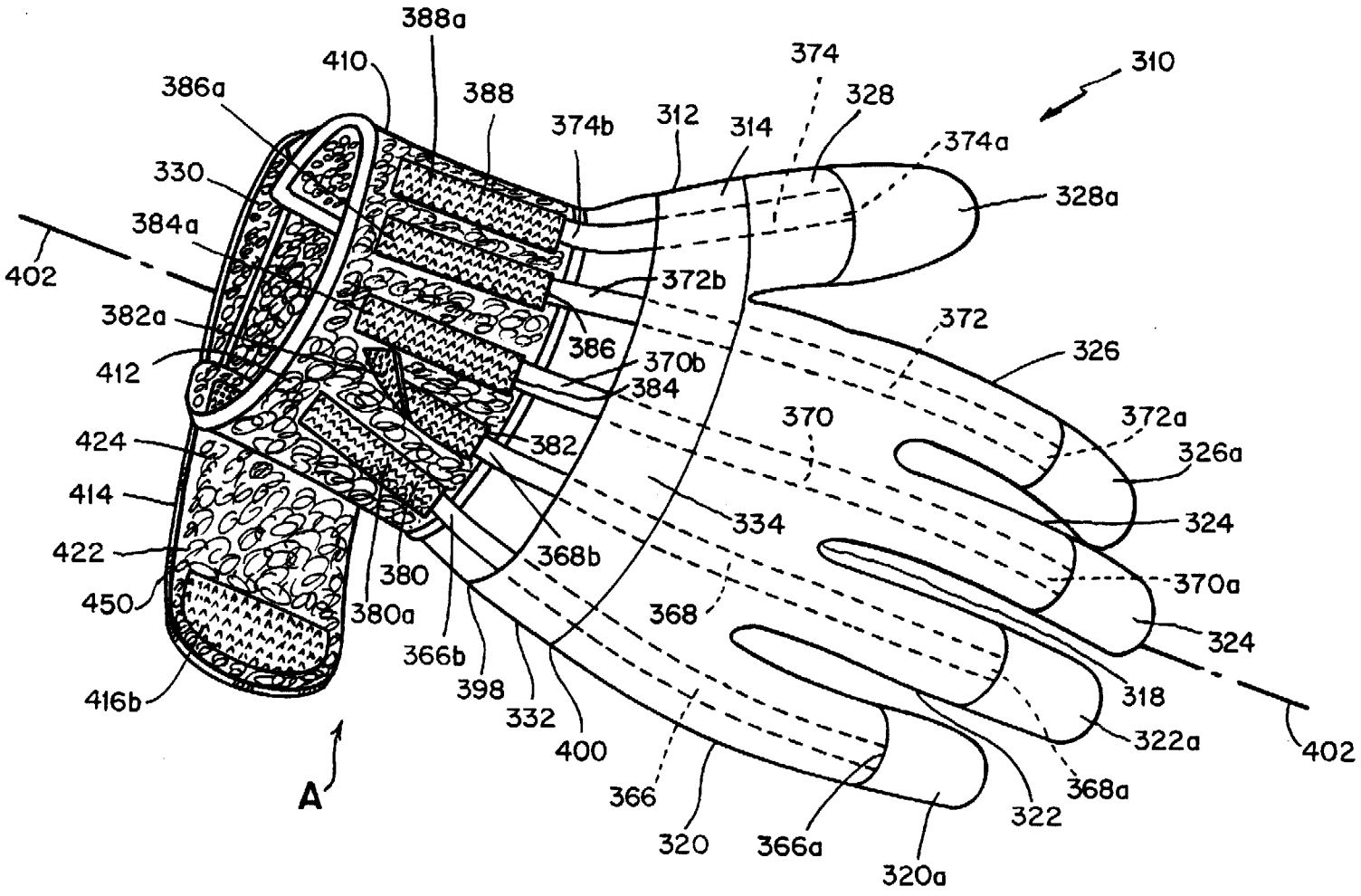
FIG. 4 is a top view of a third embodiment of the therapeutic glove of the invention.
Figure 5:
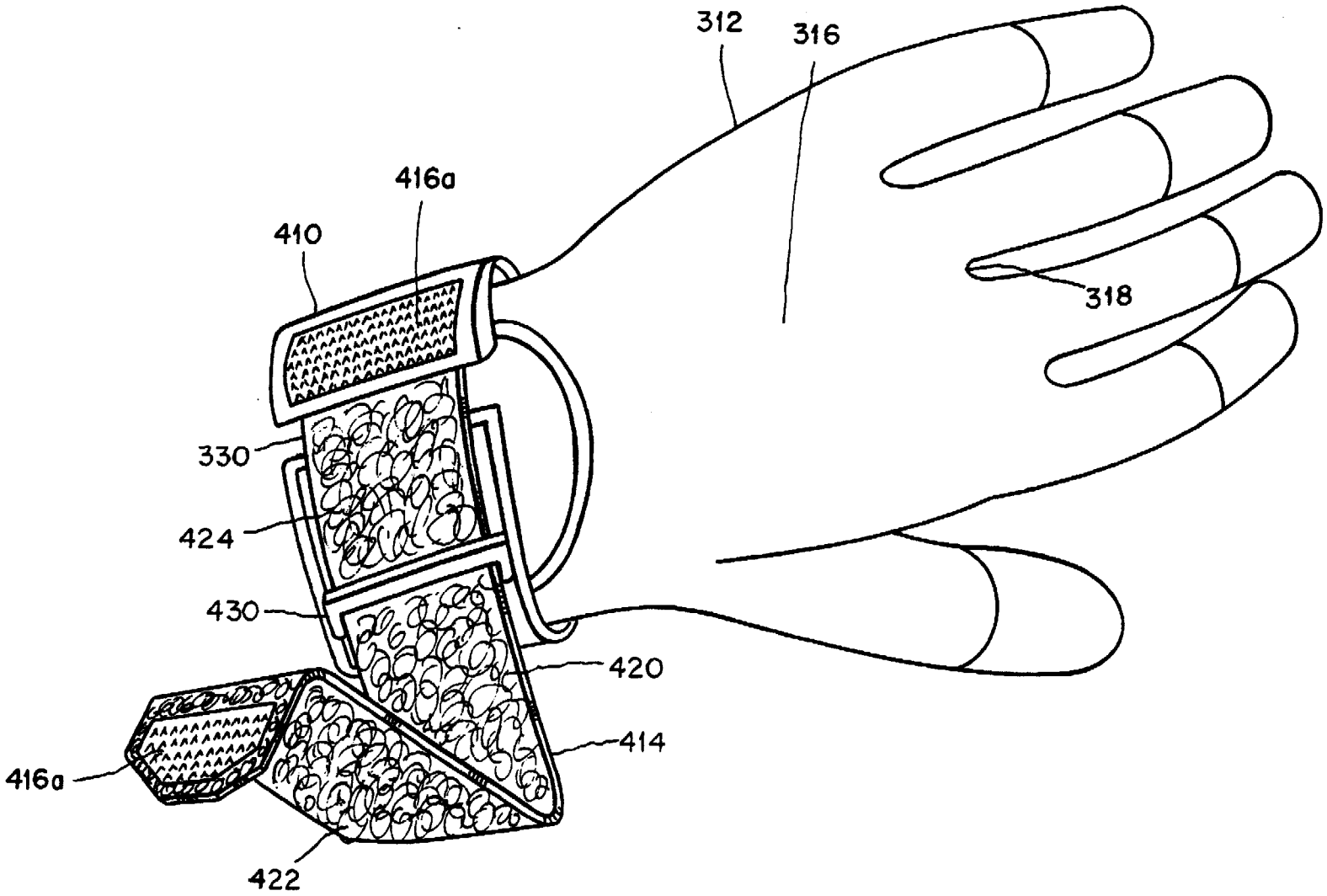
FIG. 5 is a back view of the third embodiment of FIG. 4.
Figure 6:
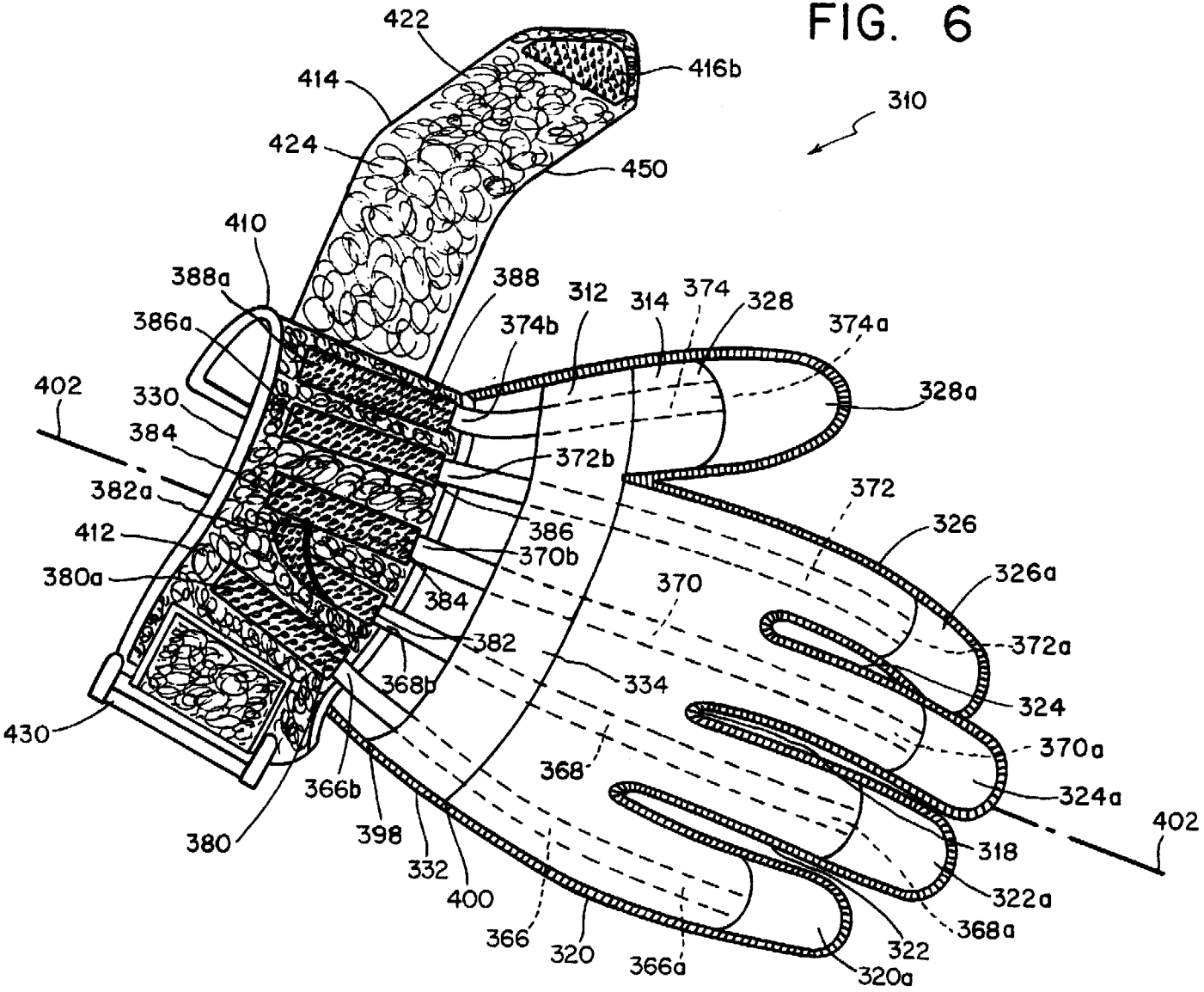
FIG. 6 is a top view of a fourth embodiment of the invention.
Figure 7:
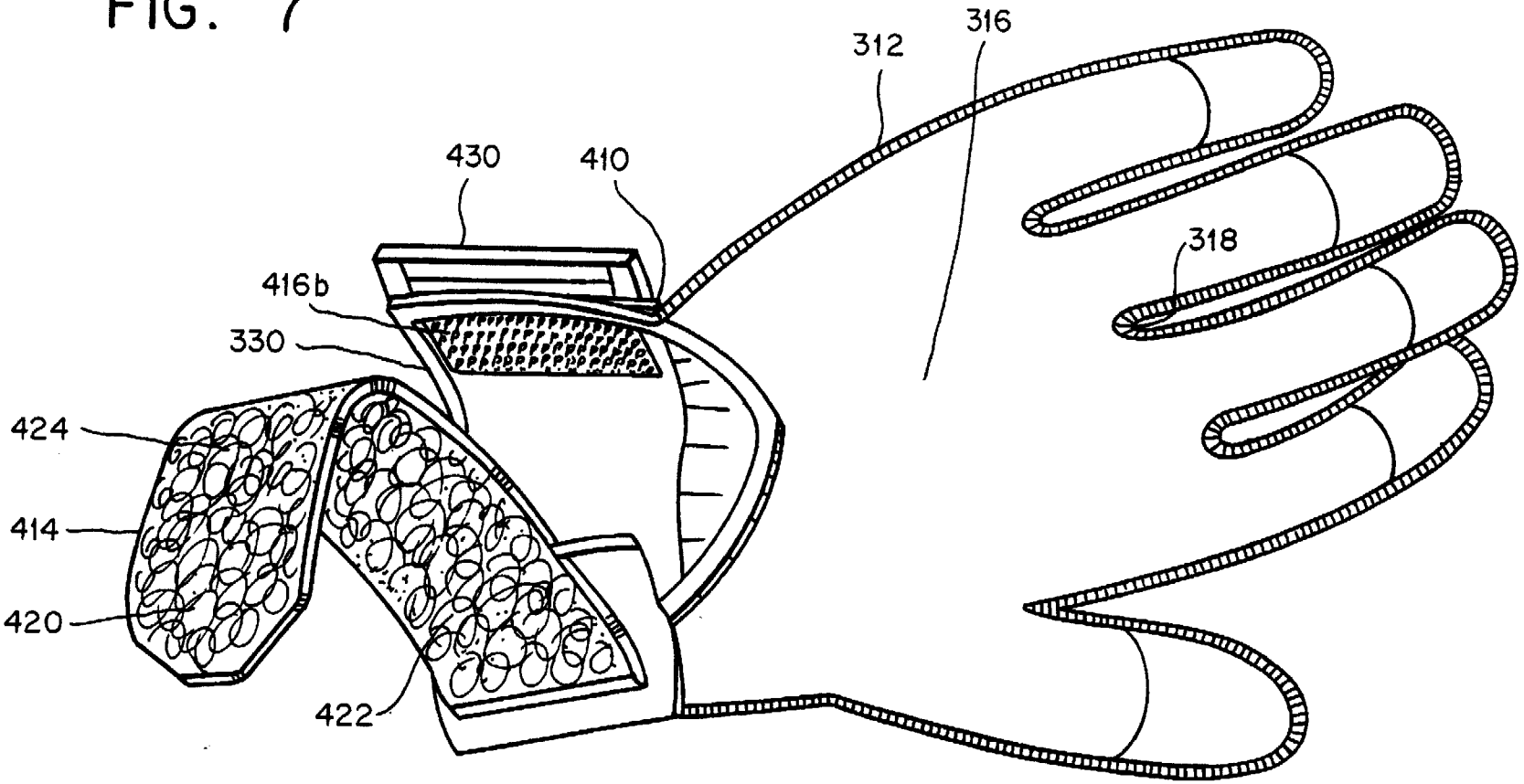
FIG. 7 is a back view of the fourth embodiment of FIG. 6.

FIGS. 4 and 5 show a third embodiment of the therapeutic glove 310, while FIGS. 6 and 7 show a fourth embodiment of the therapeutic glove 310. The third and the fourth embodiments are very similar such that the same structural features for each therapeutic glove will have the same reference numeral, whereas different structural features will have different reference numerals for the third and the fourth embodiments.

In FIGS. 4 and 5 and in FIGS. 6 and 7, the glove 310 includes a glove body 312 having a back 314 adapted to overlie the back of the hand. There is included a palm-covering portion 316 for covering the palm of the hand, a front end 318 comprising four separate finger portions 320, 322, 324 and 326 into which a finger of the hand may be inserted, and a thumb portion 328 into which the thumb of the hand may be inserted. Rear opening 330 receives the hand, and a middle part 332 positioned between the front end 318 and the rear opening 330 covers the knuckles portion 334 of the hand.

Each finger portion 320, 322, 324 and 326 has a tip 320a, 322a, 324a and 326a, respectively, and the thumb portion 328 has a tip 328a. FIGS. 4 to 7 do not show any anchor rod means such as the anchor rod means 146, 148, 150 and 152 located in middle part 132 for each finger portion and anchor rod means 154 for thumb portion 128, as shown in FIG. 3. However, it is intended that each of the third embodiment of FIGS. 4 and 5 and of the fourth embodiment of FIGS. 6 and 7 could be made to have anchor rod means.

Elastic resistance bands 366, 368, 370, 372 and 374 each have a first end and a second end disposed on the back 314 of the glove 310 and are connected, respectively, at each of the first ends 366a, 368a, 370a, 372a, and 374a to the tips 320a, 322a, 324a, 326a and 328a, and are connected at each of the second ends 366b, 368b, 370b, 372b, and 374b to the individual retaining tabs 380, 382, 384, 386, and 388, respectively.

The therapeutic glove also includes a wrist portion 410 adjacent rear opening 330. Wrist portion 410 further includes an adjustment strap 414. The individual retaining tabs may be attached to either the wrist portion 410 or the strap 414 or both. Wrist portion 410 is provided with a plurality of loops 412 extending across the back 314 of glove 310 adjacent rear opening 330 and perpendicular to a center-line longitudinal axis 402. The plurality of loops 412 on the wrist portion receive a plurality of hooks for use as a hook and loop type fastener. Adjustment strap 414 has an upper side 420 and a lower side 422, each of which have a plurality of loops 424 and have a plurality of hooks 416*a* and 416*b*, respectively, such that when adjustment strap 414 is wrapped around the users wrist, the hooks 416*b*, on the lower side 422 of said strap, engage the loops 412 on wrist portion 410 and secure the glove 310 on the hand of the user.

Individual retaining tabs each have a plurality of hooks 380*a*, 382*a*, 384*a*, 386*a* and 388*a*, respectively, disposed on the top and the bottom side thereof. When individual retaining tab 380, 382, 384, 386 and 388 is pulled into a comfortable position, the loops 412 on the wrist portion engage the hooks 380*a*, etc. on the bottom side of individual retaining tabs 380, etc., and secure elastic resistance bands 366, 368, 370, 372 and 374, respectively. The placement of each individual retaining tab allows the tension of each elastic resistance band to be adjusted individually according to the size of the users hand.

In FIGS. 4 to 7, the elastic resistance bands 366, etc. extend continuously from finger portions 320*a*, etc. to the individual retaining tabs 380 etc.. Each elastic resistance band has its own individual retaining tab attached thereto at the second end such that the tension can be adjusted for each finger individually. After the individual tabs are suitably attached to the wrist portion, then the adjustment strap 414 can be wrapped around the wrist and attached with its loops to the hooks of the individual retaining tabs top surface.

First brace means 398 and second brace means 400 adjacent to the middle part 332 each provides lateral strength for the glove body. A ventilation opening (not shown in the FIGS.) is in the palm-covering portion of the glove body. The glove also includes a center-line longitudinal axis 402, wherein the first brace means 398 and the second brace means 400 are transverse braces extending perpendicular to the longitudinal axis and adjacent to the anchor rod means.

The wrist portion 410 also has a buckle 430 through which the adjustment strap 414 may be inserted and pulled so as to tighten the glove around the hand of the user.

The differences between the embodiment shown in FIGS. 4 and 5 and the embodiment shown in FIGS. 6 and 7 are as follows. The buckle 430 in FIGS. 4 and 5 is adjacent to the thumb portion 328, while the buckle 430 in FIGS. 6 and 7 is adjacent to the little finger portion 320. In FIGS. 4 and 5, the adjustment strap 414 is attached at little finger portion 320, while in FIGS. 6 and 7 the adjustment strap 414 is attached at thumb portion 328. In FIG. 7, the strap 414 is open.

In FIG. 5, the adjustment strap 414 is first pulled through buckle 430 and then is folded back upon itself with loops 424 attaching to hooks 416*a* so as to secure the glove in place on the user's wrist, as seen in FIG. 4. As indicated in FIGS. 4 and 6, end portion 450 of strap 414 can be folded as indicated by arrow A around so that the loops 424 of the strap can be attached to the hooks on the individual tabs and the hooks 416*b* on the strap can be attached to the loops 412 of the wrist portion.

The therapeutic glove as shown in the drawings, and as described, is for use by a person with five fingers on each hand, such that on the glove there are five elastic resistance bands and five individual retaining tabs. However, the glove may be modified whenever necessary so as to be capable of being worn by a person who has fewer than five fingers, if the person's hand were deformed due to disease, injury, or surgery whereby all or part, of one of more, fingers were missing.

While only four embodiments of the present invention have been shown and described, it is to be understood that many changes and modifications may be made thereunto without department from the spirit and scope of the invention as defined in the appended claims.

What is claimed is:

1. A therapeutic glove for exercising the fingers of the hand, comprising:

a glove body having finger portions each with a tip and a thumb portion with a tip, said glove body having a back adapted to overlie the back of the hand, a palm-covering portion for covering the palm of the hand, a rear opening for receiving the hand, a wrist portion adjacent said rear opening for securing the glove to the hand, and a middle part positioned between the finger portions and the rear opening for covering the knuckle of the hand;

anchor rod means for each of said finger and thumb portions;

an elastic resistance band located on said finger and thumb portions and connecting said tips with said anchor rods;

a center line longitudinal axis;

a first brace means adjacent to said anchor rod means for providing lateral strength for said glove body; said first brace means being a transverse first brace extending perpendicular to said longitudinal axis;

a second brace means adjacent to said anchor rod means for providing lateral strength for said glove body; said second brace means being a transverse second brace extending perpendicular to said longitudinal axis and whereby whenever the fingers and the thumb of the hand are closed, the elastic resistance bands are stretched and exert a reverse counterforce tending to pull the fingers and the thumb back straight so as to open the hand and aid in exercising the fingers of the hand.

2. The therapeutic glove according to claim 1, wherein said anchor rod means are located in said middle part of the glove.

3. The therapeutic glove according to claim 1, wherein said wrist portion further comprises a plurality of loops disposed thereon and extending across the back of the glove adjacent said rear opening;

an adjustment strap having a top and a bottom, said top and bottom of said adjustment strap having a plurality of hooks disposed thereon, whereby said hooks on said bottom of said strap engage said loops on said wrist portion to secure the glove to the hand; and a retaining tab for further adjusting the fit of the glove.

4. The therapeutic glove according to claim 3, wherein said retaining tab has a top and a bottom, said bottom of said retaining tab having a plurality of loops disposed thereon, whereby said loops on said bottom of said retaining tab engage said hooks on said top side of said adjustment strap to further adjust the fit of the glove.

5. The therapeutic glove according to claim 4, further comprising elastic resilient bands having a first end and a second end; and said resilient bands disposed on said back of the glove and connected at said first ends to said anchor rod means of said finger portions and connected at said second ends to said top of said retaining tab, whereby the tension of said resilient bands can be adjusted according to the placement of said retaining tab on said adjustment strap of said wrist portion.

6. The therapeutic glove according to claim 5, wherein said elastic resistance band and said elastic resilient band are each a part of the same continuous band.

7. The therapeutic glove according to claim 5, wherein said elastic resistance band is separate and distinct from the elastic resilient band.

8. A therapeutic glove for exercising the fingers of the hand, comprising:

a glove body having finger portions each with a tip, a rear opening, a back adapted to overlie the back of the hand, a palm covering portion for covering the palm of the hand, a front end comprised of said finger portions into which a finger of the hand may be inserted, a wrist portion adjacent said rear opening for securing the glove to the hand, and a middle part positioned between said front end and said rear opening for covering the knuckles of the hand;

an elastic resistance band disposed on said finger portions and connecting together said tip and said wrist portion;

a first brace means adjacent to said elastic resistance band for providing lateral strength for said glove body;

a center line longitudinal axis;

said first brace means being a transverse first brace extending perpendicular to said longitudinal axis;

a second brace means adjacent to said elastic resistance band for providing lateral strength for said glove body;

and said second brace means being a transverse second brace extending perpendicular to said longitudinal axis.

9. The therapeutic glove according to claim 8, wherein said wrist portion further comprises:

a plurality of loops disposed thereon and extending across the back of the glove adjacent said rear opening;

an adjustment strap having a top and a bottom, said top and bottom of said adjustment strap each having a plurality of hooks disposed thereon and having a plurality of loops disposed thereon, whereby said hooks on said bottom of said strap engage said loops on said wrist portion to secure the glove to the hand; and a plurality of individual retaining tabs with there being one retaining tab for each elastic resistance band such that the tension can be adjusted for each finger individually.

10. The therapeutic glove according to claim 9, wherein each of said individual retaining tabs has a top and a bottom, said top and said bottom of said individual retaining tab having a plurality of hooks disposed thereon, whereby said hooks on said bottom of said individual retaining tab engage said loops on said top side of said wrist portion, and said hooks on said top of said tab engage said loops on the bottom side of said adjustment strap to further adjust the fit of the glove.

11. The therapeutic glove according to claim 10, wherein said elastic resistance bands having a first end and a second end and being disposed on said back of the glove, said first ends connected to said tip of said finger portions and said second ends connected to said top of said individual retaining tab, whereby the tension of said resistance bands can be adjusted according to the placement of each of said retaining tabs on said wrist portion.

* * * * *